US008104839B2

(12) United States Patent
Huang

(10) Patent No.: US 8,104,839 B2
(45) Date of Patent: Jan. 31, 2012

(54) CHAIR THAT IS ASSEMBLED AND DISASSEMBLED EASILY AND QUICKLY

(76) Inventor: Su-Nu Huang, Dongguan (CN)

( * ) Notice: Subject to any disclaimer, the term of this patent is extended or adjusted under 35 U.S.C. 154(b) by 186 days.

(21) Appl. No.: 12/582,094

(22) Filed: Oct. 20, 2009

(65) Prior Publication Data

US 2011/0089739 A1 Apr. 21, 2011

(51) Int. Cl.
*A47C 7/00* (2006.01)
*A47C 7/16* (2006.01)

(52) U.S. Cl. ..... 297/440.1; 297/400.14; 297/440.23

(58) Field of Classification Search ..... 297/440.1, 297/440.14, 440.15, 440.2, 440.23
See application file for complete search history.

(56) References Cited

U.S. PATENT DOCUMENTS 3,233,942 A * 2/1966 Creutz ..... 297/440.14
5,407,250 A * 4/1995 Prince et al. ..... 297/440.2 X
6,494,540 B1 * 12/2002 Tornero ..... 297/440.1
6,739,671 B2 * 5/2004 De Maina ..... 297/440.1 X
7,134,728 B1 * 11/2006 Buhrman ..... 297/440.14
7,300,110 B1 * 11/2007 Debien ..... 297/440.13 X

* cited by examiner

*Primary Examiner* — Anthony D Barfield

(74) *Attorney, Agent, or Firm* — Alan Kamrath; Kamrath IP Lawfirm, PA

(57) ABSTRACT

A chair includes a support frame, a seat frame detachably mounted on the support frame and a backrest frame detachably mounted on the support frame. Thus, the support frame, the seat frame and the backrest frame are combined together easily and quickly so that a user can assemble and disassemble the chair by himself without needing aid of any hand tool, thereby facilitating the user assembling and disassembling the chair. In addition, the support frame, the seat frame and the backrest frame are detached from and laminated with each other before assembly so as to reduce the whole volume of the chair and to decrease the cost of packaging, storage and transportation of the chair.

13 Claims, 5 Drawing Sheets

CHAIR THAT IS ASSEMBLED AND DISASSEMBLED EASILY AND QUICKLY

BACKGROUND OF THE INVENTION

1. Field of the Invention

The present invention relates to a chair and, more particularly, to a chair that can be detached in parts.

2. Description of the Related Art

A conventional chair comprises a support, a seat secured on the top of the support and a backrest secured on and located above the seat. However, the conventional chair has a fixed structure and cannot be detached in parts before assembly so that the conventional chair has a larger volume, thereby increasing the cost of packaging, storage and transportation of the chair.

BRIEF SUMMARY OF THE INVENTION

In accordance with the present invention, there is provided a chair, comprising a support frame, a seat frame detachably mounted on the support frame and a backrest frame detachably mounted on the support frame and located above the seat frame.

The support frame includes two side support racks. The seat frame is detachably mounted between the two side support racks of the support frame. The backrest frame is detachably mounted between the two side support racks of the support frame.

Each of the two side support racks of the support frame has an inner side provided with two fixing blocks, and the seat frame has two opposite ends each supported by the fixing blocks of a respective one of the two side support racks.

Each of the fixing blocks of each of the two side support racks is provided with a positioning hole. Each of the two opposite ends of the seat frame has a bottom provided with two threaded tubes each inserted into the positioning hole of a respective one of the fixing blocks. The chair further comprises four threaded locking knobs each screwed into a respective one of the threaded tubes of the seat frame and each abutting a respective one of the fixing blocks;

Each of the two side support racks of the support frame has an upper portion provided with a locking slit. The backrest frame has an upper portion having two opposite ends each provided with a locking plate detachably locked in the locking slit of a respective one of the two side support racks so that the upper portion of the backrest frame is releasably locked between the two side support racks of the support frame. The locking plate of the backrest frame has a bottom provided with a locking groove detachably locked onto the locking slit of the respective side support rack.

The backrest frame has a lower portion having two opposite ends each provided with a fixing plate detachably locked onto a respective one of the two side support racks so that the lower portion of the backrest frame is releasably locked between the two side support racks of the support frame. Each of the two side support racks of the support frame has a mediate portion provided with a screw bore. The fixing plate of the backrest frame is provided with a fixing hole aligning with the screw bore of the respective side support rack. The chair further comprises two threaded fastening knobs each extending through the fixing hole of the respective fixing plate and each screwed into the screw bore of the respective side support rack to lock the respective fixing plate of the backrest frame onto the respective side support rack of the support frame.

The upper portion of each of the two side support racks is provided with an opening connected to the locking slit, and the locking plate of the backrest frame is extended into and fully received in the opening of the respective side support rack.

The chair further comprises two retaining covers each detachably mounted on the upper portion of a respective one of the two side support racks and each abutting the upper portion of the backrest frame so that the upper portion of the backrest frame is releasably locked by the two retaining covers. Each of the two retaining covers is inserted into the opening of the respective side support rack and abuts the respective locking plate of the backrest frame so that the respective locking plate of the backrest frame is covered and limited by each of the two retaining covers.

The primary objective of the present invention is to provide a chair that is assembled and disassembled easily and quickly.

Another objective of the present invention is to provide a chair that is folded and detached before assembly so as to decrease the cost of packaging, storage and transportation.

According to the primary objective of the present invention, the support frame, the seat frame and the backrest frame are combined together easily and quickly by operation of the threaded locking knobs and the threaded fastening knobs so that a user can assemble and disassemble the chair by himself without needing aid of any hand tool, thereby facilitating the user assembling and disassembling the chair.

According to another objective of the present invention, the support frame, the seat frame and the backrest frame are detached from and laminated with each other before assembly so as to reduce the whole volume of the chair and to decrease the cost of packaging, storage and transportation of the chair.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
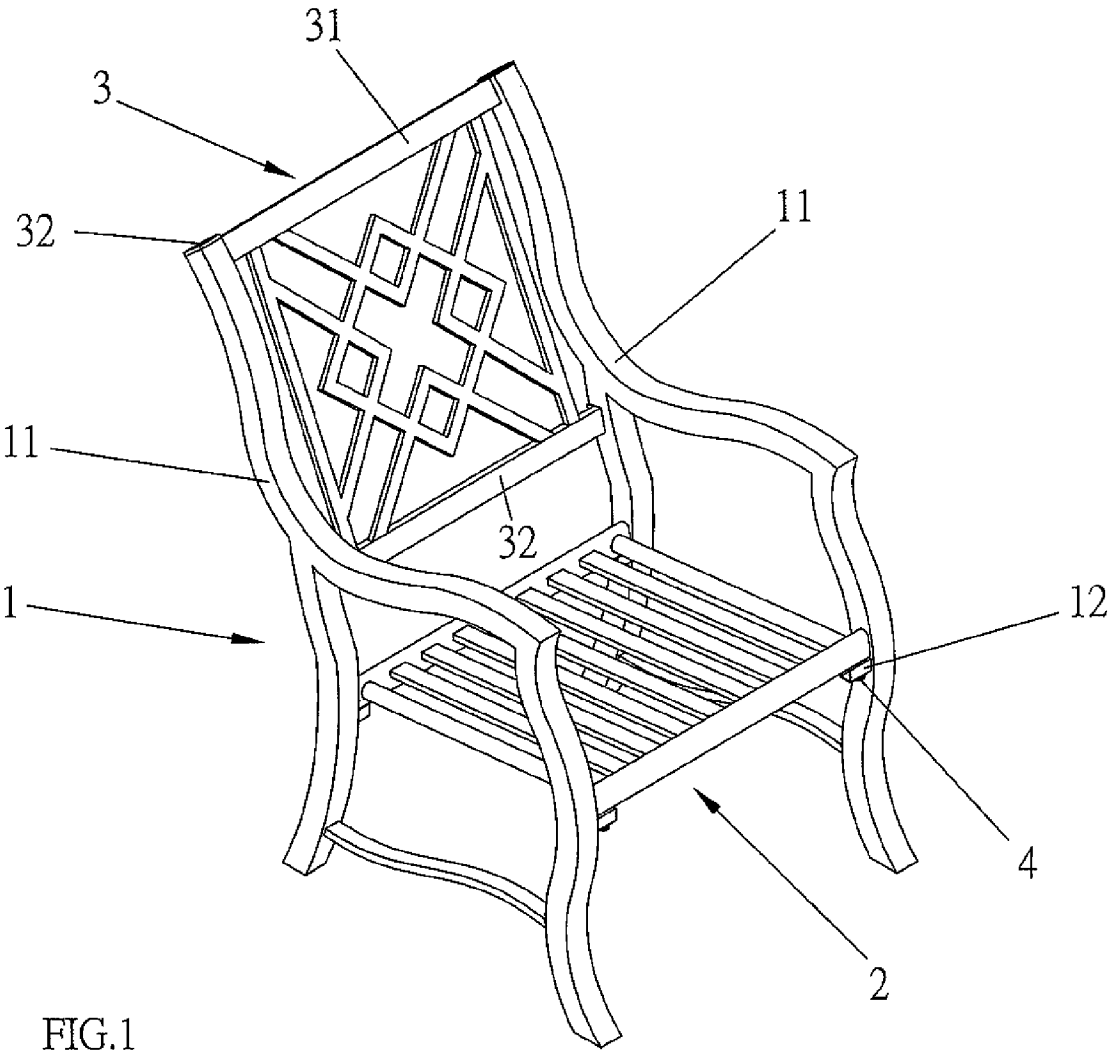
FIG. 1 is a perspective view of a chair in accordance with the preferred embodiment of the present invention.
Figure 2:
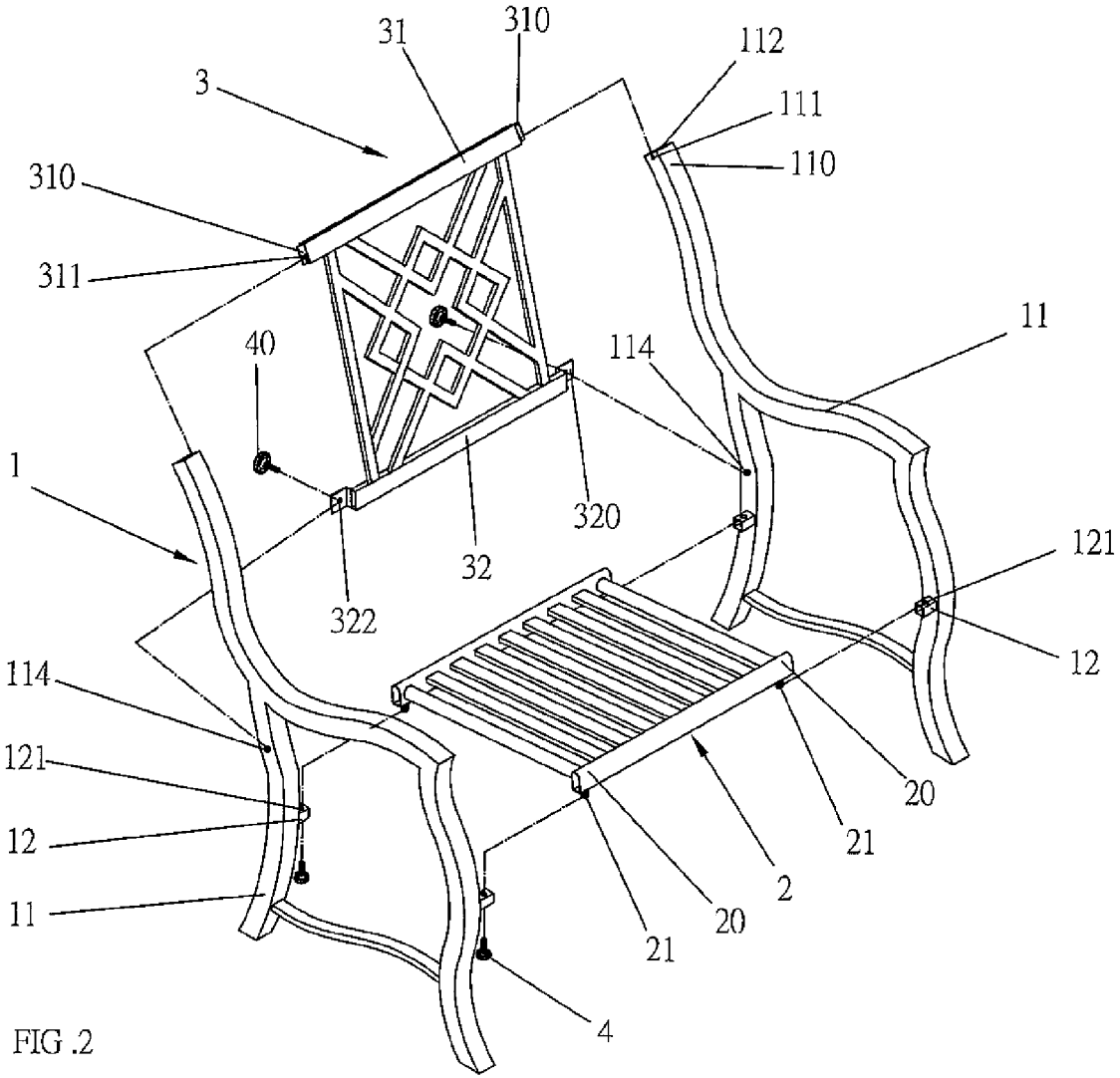
FIG. 2 is an exploded perspective view of the chair as shown in FIG. 1.
Figure 3:
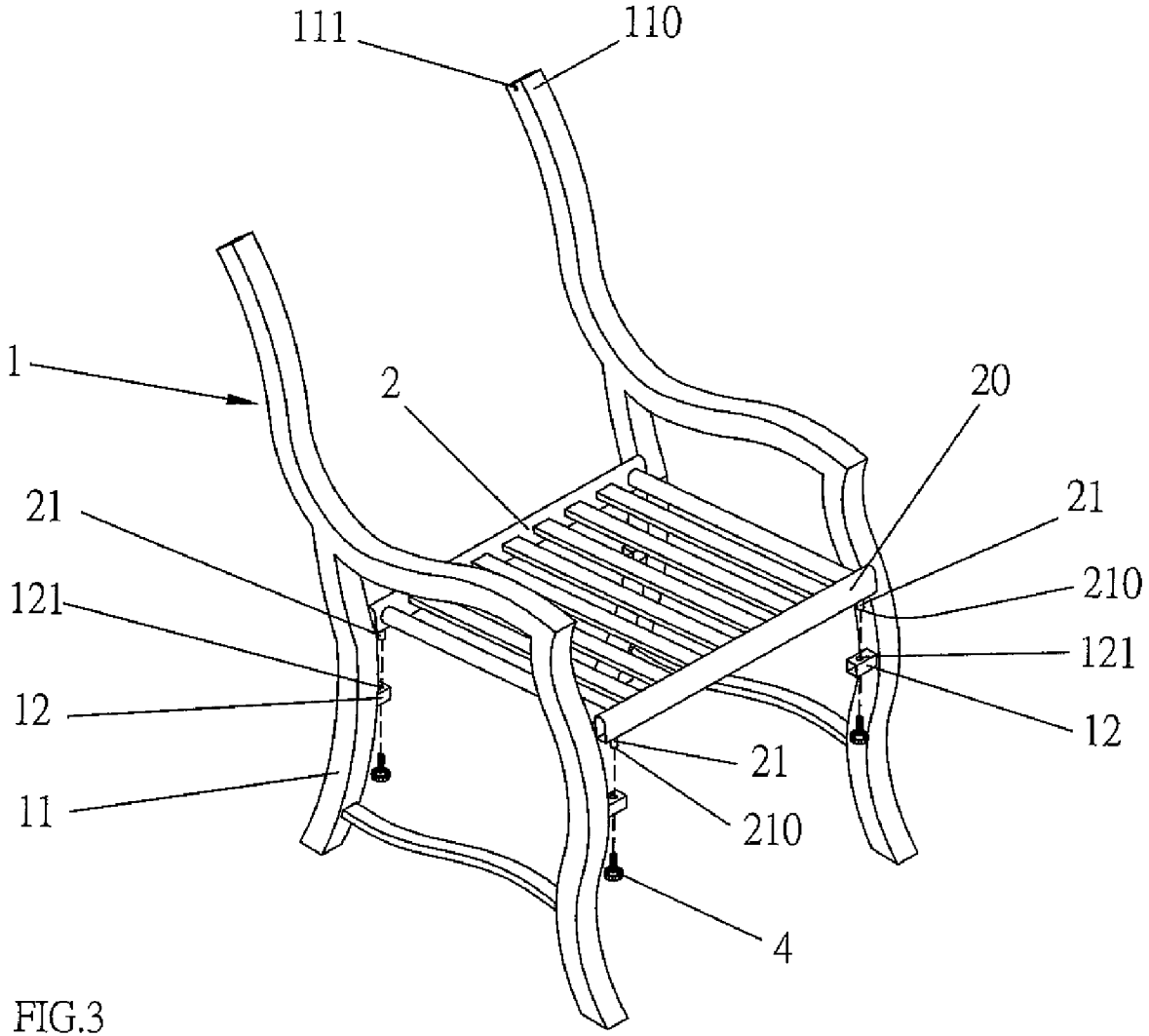
FIG. 3 is a partially exploded perspective view of the chair as shown in FIG. 1.
Figures 4, 5:
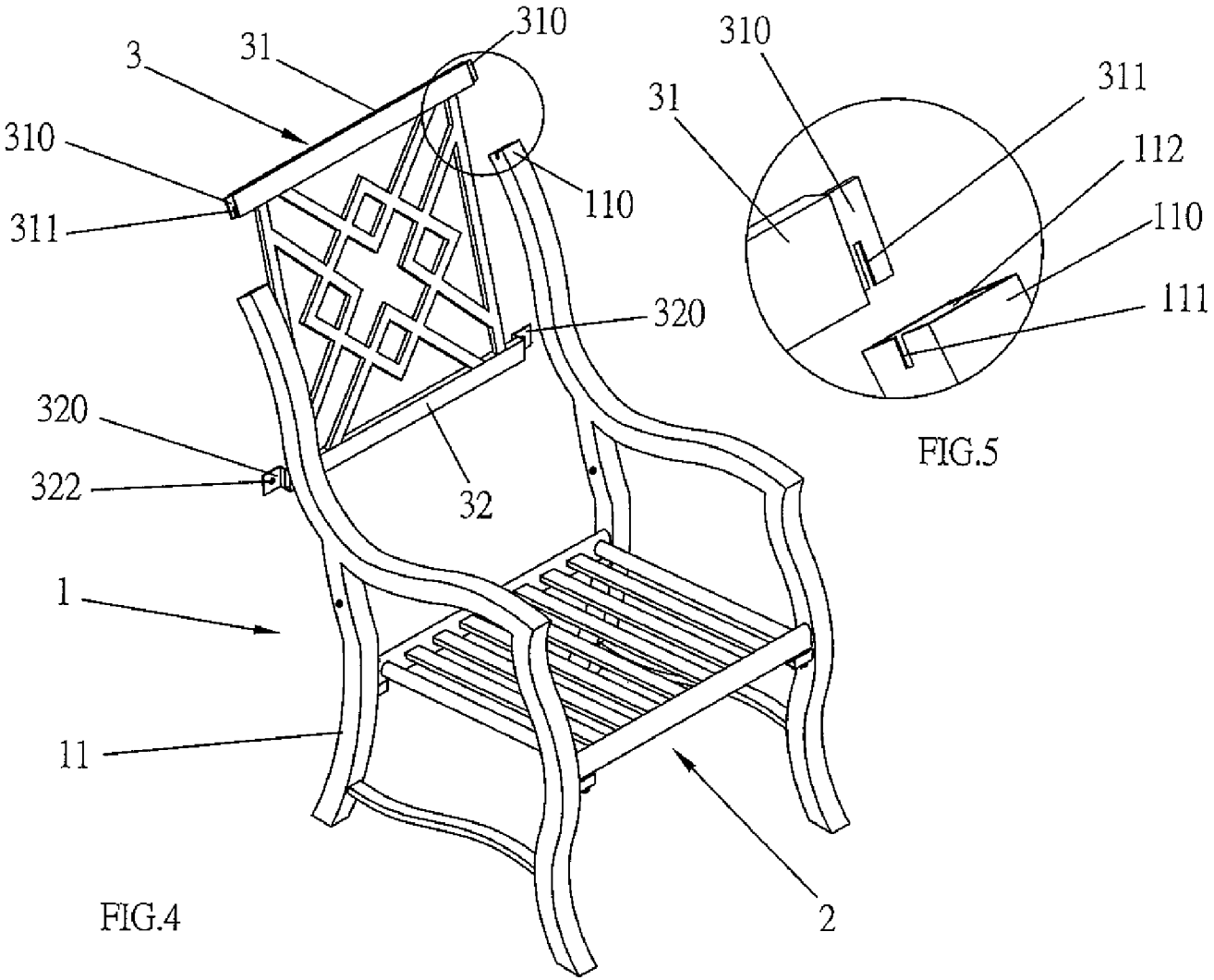
FIG. 4 is a partially exploded perspective view of the chair as shown in FIG. 1.
FIG. 5 is a locally enlarged view of the chair as shown in FIG. 4.

Referring to the drawings and initially to FIG. 1, a chair in accordance with the preferred embodiment of the present invention comprises a support frame 1, a seat frame 2 detachably mounted on the support frame 1, and a backrest frame 3 detachably mounted on the support frame 1 and located above the seat frame 2.

Referring to FIGS. 1-7, the support frame 1 includes two side support racks 11 each having an inner side provided with two fixing blocks 12. The fixing blocks 12 of each of the two side support racks 11 are mounted on a lower end of each of the two side support racks 11. Each of the fixing blocks 12 of each of the two side support racks 11 is provided with a positioning hole 121. Each of the two side support racks 11 of the support frame 1 has a sheet shape and has an upper portion 110 provided with a locking slit 111. The upper portion 110 of each of the two side support racks 11 is provided with an opening 112 connected to the locking slit 111. Each of the two side support racks 11 of the support frame 1 has a mediate portion provided with a screw bore 114.

The seat frame 2 has a sheet shape. The seat frame 2 is detachably mounted between the two side support racks 11 of the support frame 1 and has two opposite ends 20 each supported by the fixing blocks 12 of a respective one of the two side support racks 11. Each of the two opposite ends 20 of the seat frame 2 has a bottom provided with two threaded tubes 21 each inserted into the positioning hole 121 of a respective one of the fixing blocks 12, and the chair further comprises four threaded locking knobs 4 each screwed into a respective one of the threaded tubes 21 of the seat frame 2 and each abutting a respective one of the fixing blocks 12 so that the seat frame 2 is releasably locked between the two side support racks 11 of the support frame 1.

Figures 6, 7:
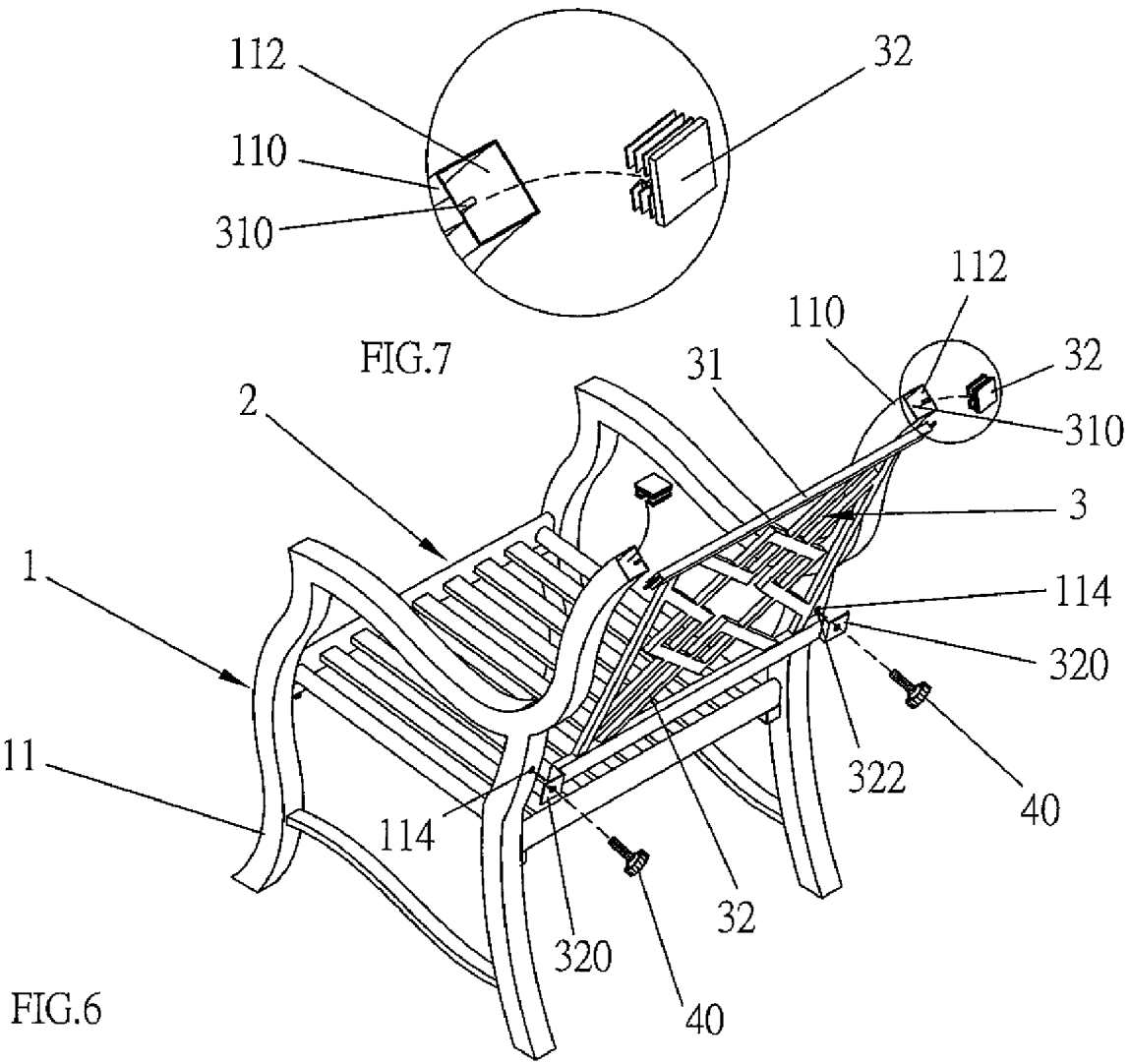
FIG. 6 is a partially rear exploded perspective view of the chair as shown in FIG. 1.
FIG. 7 is a locally enlarged view of the chair as shown in FIG. 6.

The backrest frame 3 has a sheet shape. The backrest frame 3 is detachably mounted between the two side support racks 11 of the support frame 1. The backrest frame 3 has an upper portion 31 having two opposite ends each provided with a locking plate 310 detachably locked in the locking slit 111 of a respective one of the two side support racks 11 so that the upper portion 31 of the backrest frame 3 is releasably locked between the two side support racks 11 of the support frame 1. The upper portion 31 of the backrest frame 3 is a transverse rail. The locking plate 310 of the backrest frame 3 has a bottom provided with a locking groove 311 detachably locked onto the locking slit 111 of the respective side support rack 11. The locking plate 310 of the backrest frame 3 is extended into and fully received in the opening 112 of the respective side support rack 11 as shown in FIG. 7. The backrest frame 3 has a lower portion 32 having two opposite ends each provided with a fixing plate 320 detachably locked onto a respective one of the two side support racks 11 so that the lower portion 32 of the backrest frame 3 is releasably locked between the two side support racks 11 of the support frame 1. The lower portion 32 of the backrest frame 3 is a transverse rail. The fixing plate 320 of the backrest frame 3 is provided with a fixing hole 322 aligning with the screw bore 114 of the respective side support rack 11, and the chair further comprises two threaded fastening knobs 40 each extending through the fixing hole 322 of the respective fixing plate 320 and each screwed into the screw bore 114 of the respective side support rack 11 to lock the respective fixing plate 320 of the backrest frame 3 onto the respective side support rack 11 of the support frame 1.

The chair further comprises two retaining covers 32 each detachably mounted on the upper portion 110 of a respective one of the two side support racks 11 and each abutting the upper portion 31 of the backrest frame 3 so that the upper portion 31 of the backrest frame 3 is releasably locked by the two retaining covers 32. Each of the two retaining covers 32 is inserted into the opening 112 of the respective side support rack 11 and abuts the respective locking plate 310 of the backrest frame 3 so that the respective locking plate 310 of the backrest frame 3 is covered and limited by each of the two retaining covers 32.

In assembly, each of the threaded tubes 21 of the seat frame 2 is inserted into the positioning hole 121 of a respective one of the fixing blocks 12. Then, each of the threaded locking knobs 4 is screwed into a respective one of the threaded tubes 21 of the seat frame 2 and abuts a respective one of the fixing blocks 12 so that the seat frame 2 is locked between the two side support racks 11 of the support frame 1. Then, the locking plate 310 of the backrest frame 3 is locked in the locking slit 111 of a respective one of the two side support racks 11, and the locking groove 311 of the locking plate 310 is locked onto the locking slit 111 of the respective side support rack 11 so that the upper portion 31 of the backrest frame 3 is locked between the two side support racks 11 of the support frame 1. Then, each of the threaded fastening knobs 40 is extended through the fixing hole 322 of the respective fixing plate 320 and screwed into the screw bore 114 of the respective side support rack 11 to lock the respective fixing plate 320 of the backrest frame 3 onto the respective side support rack 11 of the support frame 1 so that the lower portion 32 of the backrest frame 3 is locked between the two side support racks 11 of the support frame 1. Finally, each of the two retaining covers 32 is inserted into the opening 112 of the respective side support rack 11 and abuts the respective locking plate 310 of the backrest frame 3 so that the respective locking plate 310 of the backrest frame 3 is covered and limited by each of the two retaining covers 32. Thus, the chair is assembled as shown in FIG. 1.

Accordingly, the support frame 1, the seat frame 2 and the backrest frame 3 are combined together easily and quickly by operation of the threaded locking knobs 4 and the threaded fastening knobs 40 so that a user can assemble and disassemble the chair by himself without needing aid of any hand tool, thereby facilitating the user assembling and disassembling the chair. In addition, the support frame 1, the seat frame 2 and the backrest frame 3 are detached from and laminated with each other before assembly so as to reduce the whole volume of the chair and to decrease the cost of packaging, storage and transportation of the chair.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A chair, comprising:

a support frame;

a seat frame detachably mounted on the support frame;

a backrest frame detachably mounted on the support frame and located above the seat frame;

wherein the support frame includes two side support racks;

the seat frame is detachably mounted between the two side support racks of the support frame;

the backrest frame is detachably mounted between the two side support racks of the support frame;

each of the two side support racks of the support frame has an inner side provided with two fixing blocks which protrude outward from each of the two side support racks of the support frame;

the seat frame has two opposite ends each supported by the fixing blocks of a respective one of the two side support racks;

each of the fixing blocks of each of the two side support racks is provided with a positioning hole;

each of the two opposite ends of the seat frame has a bottom provided with two threaded tubes each inserted into the positioning hole of a respective one of the fixing blocks;

the chair further comprises four threaded locking knobs each screwed into a respective one of the threaded tubes of the seat frame and each abutting a respective one of the fixing blocks;

the seat frame is releasably locked between the two side support racks of the support frame;

each of the two side support racks of the support frame has an upper portion provided with a locking slit;

the backrest frame has an upper portion having two opposite ends each provided with a locking plate detachably locked in the locking slit of a respective one of the two side support racks;

the upper portion of the backrest frame is releasably locked between the two side support racks of the support frame;

the locking plate of the backrest frame has a bottom provided with a locking groove detachably locked onto the locking slit of the respective side support rack;

the backrest frame has a lower portion having two opposite ends each provided with a fixing plate detachably locked onto a respective one of the two side support racks;

the lower portion of the backrest frame is releasably locked between the two side support racks of the support frame;

each of the two side support racks of the support frame has a mediate portion provided with a screw bore;

the fixing plate of the backrest frame is located outside of the respective side support rack;

the fixing plate of the backrest frame is provided with a fixing hole aligning with the screw bore of the respective side support rack;

the chair further comprises two threaded fastening knobs each initially extending through the fixing hole of the respective fixing plate and each then screwed into the screw bore of the respective side support rack to lock the respective fixing plate of the backrest frame onto the respective side support rack of the support frame.

2. The chair of claim 1, wherein the fixing blocks of each of the two side support racks are mounted on a lower end of each of the two side support racks.

3. The chair of claim 1, wherein the upper portion of each of the two side support racks is provided with an opening connected to the locking slit;

the locking plate of the backrest frame is extended into and fully received in the opening of the respective side support rack.

4. The chair of claim 3, further comprising:

two retaining covers each detachably mounted on the upper portion of a respective one of the two side support racks and each abutting the upper portion of the backrest frame so that the upper portion of the backrest frame is releasably locked by the two retaining covers.

5. The chair of claim 4, wherein each of the two retaining covers is inserted into the opening of the respective side support rack and abuts the respective locking plate of the backrest frame;

the respective locking plate of the backrest frame is covered and limited by each of the two retaining covers.

6. The chair of claim 1, wherein the seat frame has a sheet shape.

7. The chair of claim 1, wherein each of the two side support racks of the support frame has a sheet shape.

8. The chair of claim 1, wherein the backrest frame has a sheet shape.

9. The chair of claim 1, wherein the upper portion of the backrest frame is a transverse rail.

10. The chair of claim 1, wherein the lower portion of the backrest frame is a transverse rail.

11. The chair of claim 1, wherein each of the fixing blocks is perpendicular to each of the two side support racks of the support frame;

the positioning hole of each of the fixing blocks of each of the two side support racks is directed upward;

each of the threaded tubes is perpendicular to the seat frame;

each of the threaded tubes of the seat frame is directed downward.

12. The chair of claim 1, wherein each of the fixing blocks is located under the seat frame to support the seat frame.

13. The chair of claim 1, wherein the fixing plate of the backrest frame is bent and has a substantially L-shaped profile;

the fixing plate of the backrest frame abuts a back of the respective side support rack of the support frame.

* * * * *